US005878000A

United States Patent [19]

Dubois

[11] Patent Number: 5,878,000

[45] Date of Patent: Mar. 2, 1999

[54] ISOLATED SENSING DEVICE HAVING AN ISOLATION HOUSING

[75] Inventor: Neil J. Dubois, Cranston, R.I.

[73] Assignee: The United States of America as represented by the Secretary of the Navy, Washington, D.C.

[21] Appl. No.: 942,192

[22] Filed: Oct. 1, 1997

[51] Int. Cl.[6] ..... H04R 1/44

[52] U.S. Cl. ..... 367/188

[58] Field of Search ..... 367/188, 173, 367/165, 171, 166, 149, 12; 310/337, 334

[56] References Cited

U.S. PATENT DOCUMENTS 3,382,481 5/1968 Baker ..... 367/165

5,392,258 2/1995 Gabrielson et al. ..... 367/149

*Primary Examiner*—Daniel T. Pihulic

*Attorney, Agent, or Firm*—Michael J. McGowan; Prithvi C. Lall; James M. Kasischke

[57] ABSTRACT

An isolation housing is used to isolate a sensor, such as a hydrophone, from pressure fluctuations or other adverse conditions caused by fluid flow in a fluid environment. The isolation housing includes a cap portion that receives the sensor and fluid from the fluid environment. The isolation housing further includes a mounting portion that mounts the housing to a structure disposed in the fluid environment. When the sensor is a hydrophone, the cap portion is made from a material having an acoustic impedance that matches the surrounding fluid environment. The cap portion further includes one or more apertures allowing gas bubbles to escape from within the cap portion. The isolation housing further includes a retaining device, such as a resilient member, that retains the sensor centrally within the cap portion and isolates the sensor from structural vibrations or other adverse effects caused by the structure.

18 Claims, 1 Drawing Sheet

ISOLATED SENSING DEVICE HAVING AN ISOLATION HOUSING

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1). Field of the Invention

The present invention relates to an isolated sensing device and in particular, to a flow noise isolation housing for isolating flow noise from a hydrophone.

(2). Description of the Prior Art

The measurement of underwater sound is of increasing interest, particularly in underwater direction and range finding equipment (e.g., sonar). Sound is created in a water environment by a source of acoustic energy that generates an acoustic pressure field in the water. The sound pressure level is typically measured with pressure measuring or sensing devices, such as underwater microphones or hydrophones.

One difficulty with underwater measurements of a sound pressure level is the adverse affect of fluid flow noise on the sound measurement by a hydrophone. When fluid flows over the hydrophone, pressure fluctuations caused by the flow are sensed in addition to the acoustic pressures generated by the acoustic energy source. The resulting sound pressure level measurements are distorted and unclear as a result of the affect of the non-acoustic pressure fluctuations or "flow noise" caused by the flowing fluid, similar to the effect created by blowing over a microphone. Existing hydrophones do not accurately measure acoustic pressure or sound in an underwater environment because this flow noise is not effectively isolated from the hydrophone.

SUMMARY OF THE INVENTION

Accordingly, one object of the present invention is to provide an isolation housing that isolates a sensing device or hydrophone from flowing fluid and therefore isolates the pressure fluctuations or other adverse conditions caused by the flowing fluid, allowing the desired conditions, such as acoustic pressure, to be accurately and clearly measured.

A further object of the isolation housing is to mount the sensing device in a way that isolates the sensor or hydrophone from any structural vibrations.

The present invention features an isolation housing for isolating at least one sensor from pressure fluctuations (flow noise) or other undesirable conditions in a flowing fluid. The isolation housing includes a cap portion having an interior region for receiving the sensor and fluid from the fluid environment. The cap portion further includes one or more apertures extending through the cap portion into the interior region, for allowing gas to escape so that fluid fills the interior region of the cap portion. A retaining device is disposed within the cap portion for retaining the sensor within the interior region of the cap portion and for isolating the sensor from structural vibrations or other effects of the structure.

One example of the sensor includes a hydrophone. In an isolation housing for a hydrophone, the cap portion is preferably made of a material having an acoustic impedance which substantially matches the fluid to allow the hydrophone to measure acoustic pressure. According to one embodiment, the fluid includes water and the material of the cap includes polyvinylchloride (PVC).

A mounting portion is preferably coupled to the cap portion for mounting the cap portion to a structure. One embodiment of the mounting portion includes a base portion coupled to the cap portion such that the base portion is mounted to one or more ribs extending from the structure. Another embodiment of the mounting portion further includes a clamp member mounting the base portion to the structure.

One embodiment of the retaining device includes a resilient member, such as a rubber band, coupled to opposing sides of the interior region of the cap portion. The resilient member suspends the sensor proximate a central region of the interior region of the cap portion.

BRIEF DESCRIPTION OF THE DRAWINGS

These and other features and advantages of the present invention will be better understood in view of the following description of the invention taken together with the drawings wherein.

DESCRIPTION OF THE PREFERRED EMBODIMENT

Figure 1:
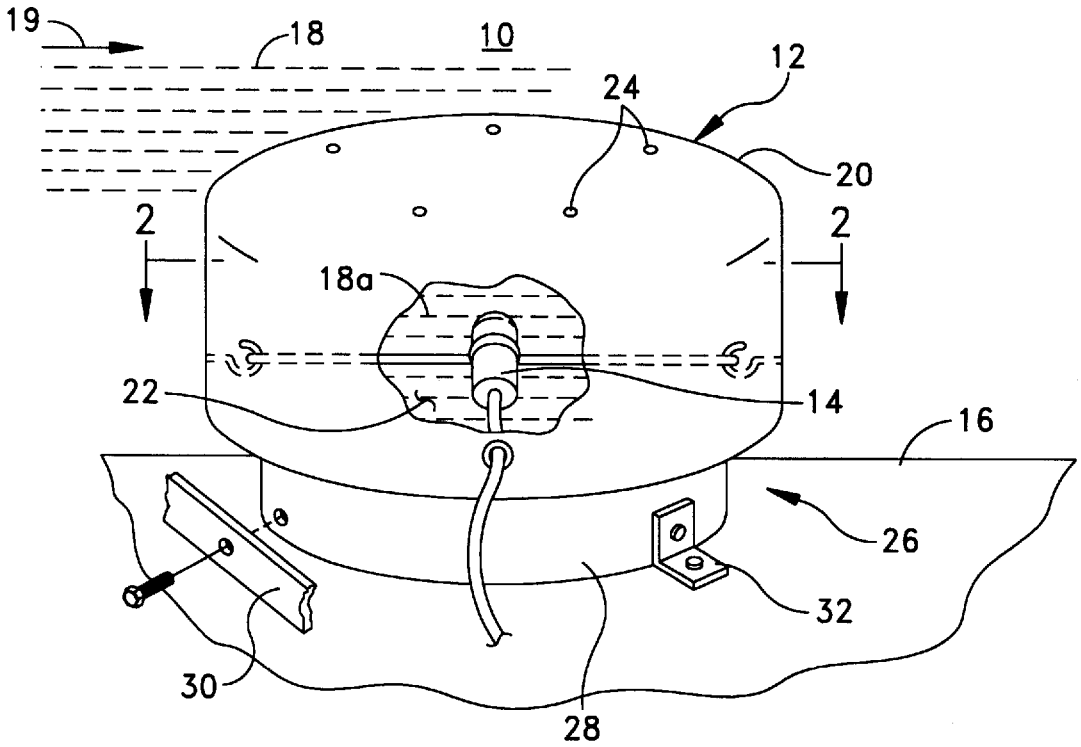
FIG. 1 is a side perspective view of an isolation housing according to the present invention.

An isolated sensing device 10, FIG. 1, according to the present invention includes an isolation housing 12 and at least one sensor 14, such as a hydrophone, housed within the isolation housing 12. The isolated sensing device 10 is typically mounted to a structure 16 in a fluid environment having a fluid 18 that flows as shown generally by arrows 19. According to one example, the isolated sensing device 10 is used in an underwater environment, such as on submarines, torpedoes, ships or other underwater vessels to measure acoustic pressure or sound in the underwater environment where flow occurs (e.g., as used in sonar systems). In the exemplary embodiment, the sensor 14 is a pressure measuring device such as a hydrophone or miniature hydrophone.

The isolation housing 12 includes a cap portion 20 defining an interior region 22 that receives the sensor 14 and fluid 18*a* from the fluid environment 18. When used to isolate a hydrophone, the cap portion 20 is preferably made of a material having an acoustic impedance which substantially matches the fluid 18, such as polyvinylchloride (PVC) when the fluid is water. Matching the acoustic impedance allows the sound to be accurately measured through the cap portion 20 and fluid 18*a*. The present invention contemplates other materials that match the acoustic impedance of water or any other type of fluid in which the isolated sensing device 10 is used.

The cap portion 20 includes one or more apertures 24 located at the top and/or sides of the cap portion 20. The apertures 24 extend into the interior region 22 of the cap portion 20, allowing any air or gas bubbles trapped inside the cap portion 20 to escape, and ensuring that the cap portion 20 is completely flooded so that the air bubbles do not adversely affect the measurements or readings of the sensor 14.

When the sensor 14 measures acoustic pressure, flowing fluid 18 creates pressure fluctuations or "flow noise" that adversely affect the measurement of acoustic pressure by the sensor 14. Shielding the sensor 14 from the flowing fluid 18 with the cap portion 20 prevents the sensor 14 from measuring the undesirable pressure fluctuations caused by the flowing fluid 18. Since the sensor 14 is suspended in the same fluid 18*a* as the fluid environment and the cap portion 20 is made of a material having an impedance that generally matches the fluid 18, 18*a*, the sensor 14 accurately measures the acoustic pressure or sound.

The isolation housing 12 further includes a mounting portion 26, for mounting the isolation housing 12 to the structure 16. The mounting portion 26 preferably includes a base portion 28 coupled to the cap portion 20, for example, using PVC cement. Alternatively, the cap 20 could be mounted directly to the structure 16. According to one embodiment, the base portion 28 is mounted to ribs 30 or other similar members extending from the structure 16, such as by bolting or other suitable fastening methods. According to another embodiment, one or more clamp members 32, such as angle clamps, are screwed or otherwise secured to the base portion 28 and structure 16. The present invention contemplates other methods and mechanisms for mounting the isolation housing 10 to the structure 16.

Figure 2:
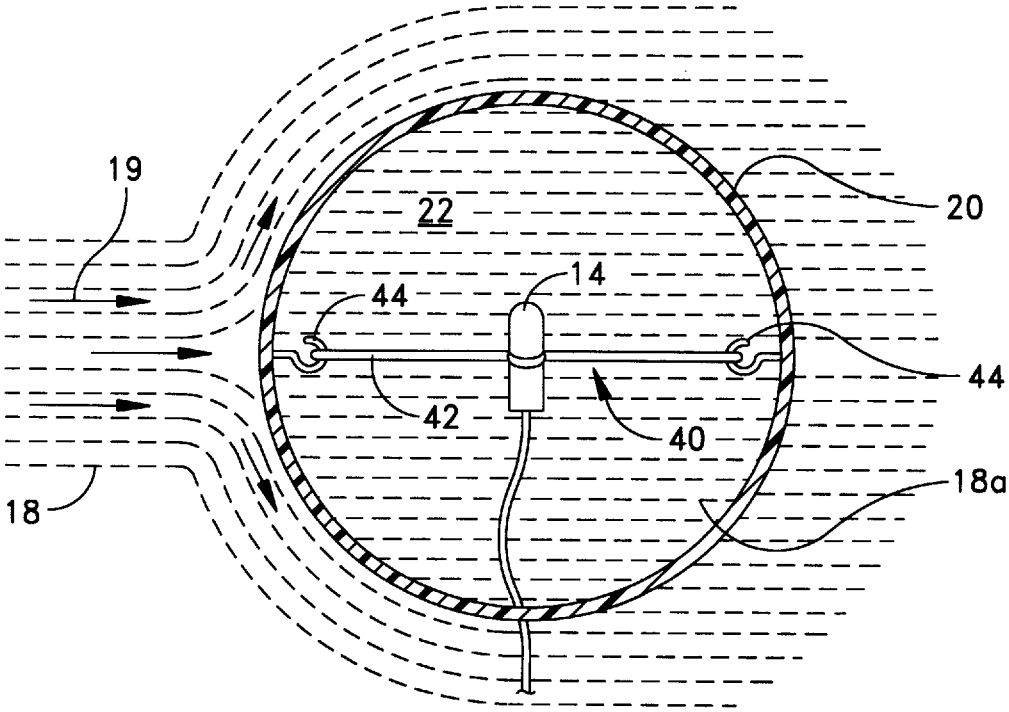
FIG. 2 is a top, cross-sectional view taken along line 2—2 of the isolation housing shown in FIG. 1, according to the present invention.

The isolation housing 10 further includes a retaining device 40, FIG. 2, that is disposed within the interior region 22 of the cap portion 20 and retains the sensor 14 such that the sensor 14 is suspended in the interior region 22 and yet isolated from structural vibrations or other effects caused by the structure 16 as well as the flowing fluid 18. The retaining device 40 preferably includes a resilient member 42, such as a rubber band, secured to opposing sides of the interior region 22, such as by eye hooks 44. The sensor 14 is thereby retained and suspended in a central region of the interior region 22 and is surrounded by fluid 18*a*.

Accordingly, the isolation housing of the present invention provides a simple, inexpensive means for isolating a sensor from pressure fluctuations (flow noise) or other undesirable conditions in a flowing fluid and allows the sensor to accurately sense or measure the desired conditions, such as acoustic pressure, in an underwater environment. The flow noise isolation housing also isolates the sensor from structural vibrations and eliminates gas bubbles that may adversely affect measurements.

In light of the above, it is therefore understood that within the scope of the appended claims, the invention may be practiced otherwise than as specifically described.

What is claimed is:

1. An isolation housing, for isolating at least one sensor from adverse conditions caused by flowing fluid in a fluid environment, said isolation housing comprising:

a cap portion having an interior region, for receiving the sensor and fluid from the fluid environment, said cap portion having at least one aperture extending through said cap portion into said interior region of said cap portion; and a retaining device, disposed within said cap portion, for retaining the sensor within said interior region of said cap portion.

2. The isolation housing of claim 1 wherein said cap portion is made of a material having an acoustic impedance which substantially matches the acoustic impedance of the fluid.

3. The isolation housing of claim 2 wherein said fluid includes water and said material includes polyvinylchloride (PVC).

4. The isolation housing of claim 1 wherein:

said at least one sensor includes a pressure-sensing device; and said cap portion isolates said pressure sensing device from pressure fluctuations caused by flowing fluid proximate said pressure-sensing device.

5. The isolation housing of claim 4 wherein said pressure-sensing device includes a hydrophone.

6. The isolation housing of claim 1 further including a mounting portion, coupled to said cap portion for mounting said cap portion to a structure.

7. The isolation housing of claim 6 wherein said mounting portion includes:

a base portion coupled to said cap portion; and at least one rib positioned on the structure wherein said base portion is mounted to said at least one rib.

8. The isolation housing of claim 6 wherein said mounting portion includes:

a base portion coupled to said cap portion; and at least one clamp member joined to the structure, said base portion being joined to said at least one clamp member.

9. The isolation housing of claim 1 wherein said retaining device includes a resilient member coupled to opposing sides of said interior region of said cap portion, said resilient member supporting the sensor proximate a central region of said interior region of said cap portion, and whereby the sensor is isolated from structural vibrations.

10. The isolation housing of claim 9 wherein said resilient member includes a rubber band.

11. An isolated sensing device for use in a fluid environment, said isolated sensing device comprising:

a cap portion, for mounting to an external structure, said cap portion having an interior region filled with fluid from said fluid environment, said cap portion having at least one aperture extending through said cap portion into said interior region of said cap portion; and at least one sensor, suspended within said interior region of said cap portion such that said at least one sensor is isolated from flowing fluid in said fluid environment and from structural vibrations in said structure.

12. The isolated sensing device of claim 11 wherein said cap portion is made of a material having an acoustic impedance which substantially matches an acoustic impedance of said fluid.

13. The isolated sensing device of claim 12 wherein said fluid includes water and said material includes polyvinylchloride (PVC).

14. The isolated sensing device of claim 11 wherein said at least one sensor includes a pressure-measuring device.

15. The isolated sensing device of claim 14 wherein said pressure-measuring device includes a hydrophone.

16. The isolated sensing device of claim 11 wherein said cap portion is mounted to a surface of a structure in an underwater environment.

17. The isolated sensing device of claim 11 further including a retaining device, disposed within said cap portion and joined to said at least one sensor, for suspending said at least one sensor within said interior region of said cap portion and for isolating the sensor from structural vibrations.

18. The isolated sensing device of claim 17 wherein said retaining device includes a resilient member coupled to opposing sides of said interior region of said cap portion, said resilient member suspending said at least one sensor proximate a central region of said interior region of said cap portion.

* * * * *